US005921411A

United States Patent [19]

Merl

[11] Patent Number: 5,921,411

[45] **Date of Patent: *Jul. 13, 1999**

[54] SHELF ASSEMBLY

[76] Inventor: Milton J. Merl, #2 Lochsus La., Pomona, N.Y.

[ * ] Notice: Under 35 U.S.C. 154(b), the term of this patent shall be extended for 00 days. Under 35 U.S.C. 154(b), the term of this patent shall be extended for This patent is subject to a terminal disclaimer.

[21] Appl. No.: 08/871,816

[22] Filed: Jun. 9, 1997

[51] Int. Cl.[6] ..... A47F 5/08

[52] U.S. Cl. ..... 211/90.01; 211/90.02; 211/94.01; 211/103; 108/108; 248/250

[58] Field of Search ..... 211/59.2, 59.3, 211/90.01, 90.02, 90.04, 94.01, 103, 135, 187; 248/220.41, 220.43, 235, 239, 250, 243; 108/108, 110

[56] References Cited

U.S. PATENT DOCUMENTS

| | | | |
|---|---|---|---|
| 2,730,825 | 2/1956 | Wilds | 211/59.2 X |
| 2,837,219 | 6/1958 | Ferdinand et al. | 211/147 X |
| 3,185,426 | 5/1965 | Bjerke | 248/250 |
| 3,234,897 | 2/1966 | Berk | 108/152 |
| 3,511,193 | 5/1970 | Schild | 108/152 |
| 3,556,306 | 1/1971 | Shell | 211/187 X |
| 3,701,325 | 10/1972 | Fenwick | 108/1 |
| 3,741,131 | 6/1973 | Leadbetter | 108/97 |
| 3,765,344 | 10/1973 | Ferdinand et al. | 108/108 |
| 3,995,736 | 12/1976 | Lawson et al. | 206/386 |
| 4,294,363 | 10/1981 | Oztekin et al. | 211/59.2 |
| 4,348,001 | 9/1982 | Baldwin | 248/243 |
| 4,653,651 | 3/1987 | Flum | 211/59.4 |
| 4,735,321 | 4/1988 | Day | 206/597 |
| 4,951,908 | 8/1990 | Kallio | 211/90.01 X |
| 5,277,393 | 1/1994 | Nicholson et al. | 108/108 X |
| 5,655,740 | 8/1997 | Lazarus | 248/243 X |
| 5,715,957 | 2/1998 | Merl | 211/187 |

*Primary Examiner*—Daniel P. Stodola
*Assistant Examiner*—Vestan Bo Booth
*Attorney, Agent, or Firm*—Schweitzer Cornman Gross & Bondell LLP

[57] ABSTRACT

A shelf assembly has a shelf unit and pair of shelf brackets adapted to be mounted on aperture-bearing uprights of a gondola shelving support system. The shelf unit has a product-supporting panel with integral, outwardly and downwardly-extending side flanges adapted to engage outside surfaces of the shelf brackets to limit the lateral movement of said shelf unit. A thin, corrugated support structure is connected to the underside of the panel and spans between the side flanges. The support structure is spaced from the side flanges forming gaps allowing the shelf brackets to contact the underside of the panel to reduce the vertical space occupied by said shelf assembly. Stops associated with the shelf brackets and the shelf unit limit the forward and rearward movement of the shelf with respect to the shelf brackets. Integral front and rear flanges extend upwardly from the panel and provide boundaries for products supported thereon. A channel member is connected to the front flange to provide rigidity and a means to attach label supporting structure. The shelf brackets can be connected to uprights of a shelving support system adaptable to products of various sizes and configurations.

18 Claims, 5 Drawing Sheets

3
3
12
20
22
24
26
28
30
44
46
47
48
49
51

28
54
52
24
26
10
12
50
6
6
20
22
94
51
57
48
48
51
14
14
56
26
26
51
12
50
14
56
46
30
56
46
22
50
14

SHELF ASSEMBLY

The present invention relates to a merchandising system and more particularly to an improved shelving assembly for use in conjunction with currently available store shelf mounts and gondolas.

BACKGROUND OF THE INVENTION

The majority of inventory in retail stores is carried in a form of shelving construction utilizing gondolas or trays for the products. Such format has changed little over the years. A floor platform supports a vertical upright backing board which defines the gondola. The gondola includes vertical weight-supporting uprights having a plurality of vertical slots. The slots and uprights are adapted to support shelving and other elements in or on which merchandise is placed for display. While such gondolas are typically employed for the display of goods directly on the selling floor, similar structures are employed in freezer cases and the like for the display and storage of refrigerated goods.

Such gondolas are required to display and support an ever increasing number of products in a staggering assortment of packaging and in an ever decreasing amount of space. However, the current gondola shelving systems typically use space relatively inefficiently and are ill-equipped to handle a variety of products. The result is that there is typically not enough gondola space available to keep and display all the desired products neatly and efficiently.

Conventional gondola shelving generally consists of a horizontal shelf panel supported by outwardly-extending brackets connected to vertical supports. To reduce their weight and cost, such shelves are often constructed with a relatively thin upper panel, sometimes formed of sheet metal. Since such panels are usually not strong enough to support any significant amount of weight, or sometimes even their own weight, additional support must be provided for the panel.

In some shelving systems the additional support and stiffening of the panel is provided by two channel members connected to and extending underneath the panel between the outwardly-extending brackets. This method is somewhat effective. However, the channel members extend a significant distance below the bottom of the panel thereby increasing the thickness of the shelf and decreasing the useable space and efficiency of the gondola.

Support and stiffening of some shelving systems is, in some cases, also provided by downwardly-extending front and/or back shelf-lips, oriented perpendicular to the panel surface, i.e., normally vertically. Such lips can increase the rigidity of the shelf, however, they can interfere with the stocking and removal of items on a shelf immediately below and can therefore require additional spacing between adjacent shelves. This results in the decrease in useable space and efficiency discussed above.

Furthermore, conventional gondola shelves are not designed to be incorporated in shelving systems which are adaptable to products having varying sizes and shapes.

Therefore, what is desired is a shelving system which is of a light-weight and economical construction which is rigid and able to support a significant amount of weight and which has a low profile such that it can be incorporated in a gondola system adapted to efficiently display products of varying sizes and shapes.

OBJECTS AND ADVANTAGES OF THE PRESENT INVENTION

Accordingly, an object of the present invention is to provide an improved shelf assembly which utilizes display space efficiently.

Another object of the present invention is to provide an improved shelf assembly which can be incorporated in a gondola system adapted to efficiently accommodate products of varying shapes and sizes.

Still another object of the present invention is to provide an improved shelf assembly which is light-weight and economical to manufacture.

Yet another object of the present invention is to provide an improved shelf assembly of the above character which is rigid and strong and which has a low profile such that it occupies a minimum amount of space.

A further object of the present invention is to provide an improved shelf assembly which has a minimum distance between the top of the product-supporting surface and the bottom of the outwardly-extending brackets thereby maximizing the useable space of the gondola.

BRIEF DESCRIPTION OF THE INVENTION

In accordance with the foregoing and other objects, the present invention consists of a space-efficient gondola shelf assembly which can be incorporated in a shelving system adapted for products having various sizes and shapes. The shelf assembly comprises a horizontal panel supported by brackets adapted to be mounted on the uprights of such shelving systems. The sides of the panel include integral, outwardly-extending and downwardly-turned flanges which provide rigidity and which engage the brackets to provide lateral stability to the shelf. The shelf also includes upwardly-turned flanges on the front and back edges thereof which provide boundaries to confine the product mounted on the shelf as well as provide rigidity for the shelf. In addition, the front flange provides a surface on which structure for a strip-label holder may be mounted.

While the above-described flanges provide support and rigidity for the shelf, the majority of the shelf's rigidity is provided by a corrugated support structure connected to the underside of the panel. The corrugated support structure comprises a plurality of integrally connected channel members preferably spot welded to the underside of the panel. The channel members extend from adjacent one side of the shelf to adjacent the opposite side and are evenly spaced from the front to the back of the shelf such that the panel is supported evenly substantially the entire surface.

A gap exists between the corrugated support structure and the downwardly-turned portion of each side flange to accommodate the brackets which engage the underside of the panel. The gap reduces the distance between the top surface of the product-supporting panel and the bottom of the brackets thereby increasing the useable space of the gondola unit. The side flanges of the panel are spaced such that they engage the outside surfaces of the brackets to provide lateral stability to the shelf. Additionally, the brackets include upwardly-extending portions on the forward ends which abut the forward ends of the outwardly-extending portions of side flanges as well as the upwardly-turned front flange of the panel, thereby providing additional stability to the shelf.

The shelf assembly is designed to cooperate with and compliment the shelving support system described in U.S. Pat. No. 5,715,957, the disclosure of which is herein incorporated by reference. The shelving support system consists of a rigid structure which mounts on the vertical supports of a conventional gondola system and which provides a means for fine adjustment of the placement of shelves. Specifically, the shelving support system comprises end brackets which mount onto the vertical supports of a conventional gondola system, crossbars which mount on the end brackets, and auxiliary vertical uprights which mount on the crossbars. The auxiliary uprights include vertical columns of closely-spaced slots which provide an increased number of mounting positions for the shelves. The vertical position of the shelving support system relative to the gondola can also be adjusted to provide further flexibility.

The shelf brackets of the present invention are preferably adapted to mount on such auxiliary vertical supports so that the shelf assembly can be used in conjunction with such a shelving support system.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figures 1, 2, 3:
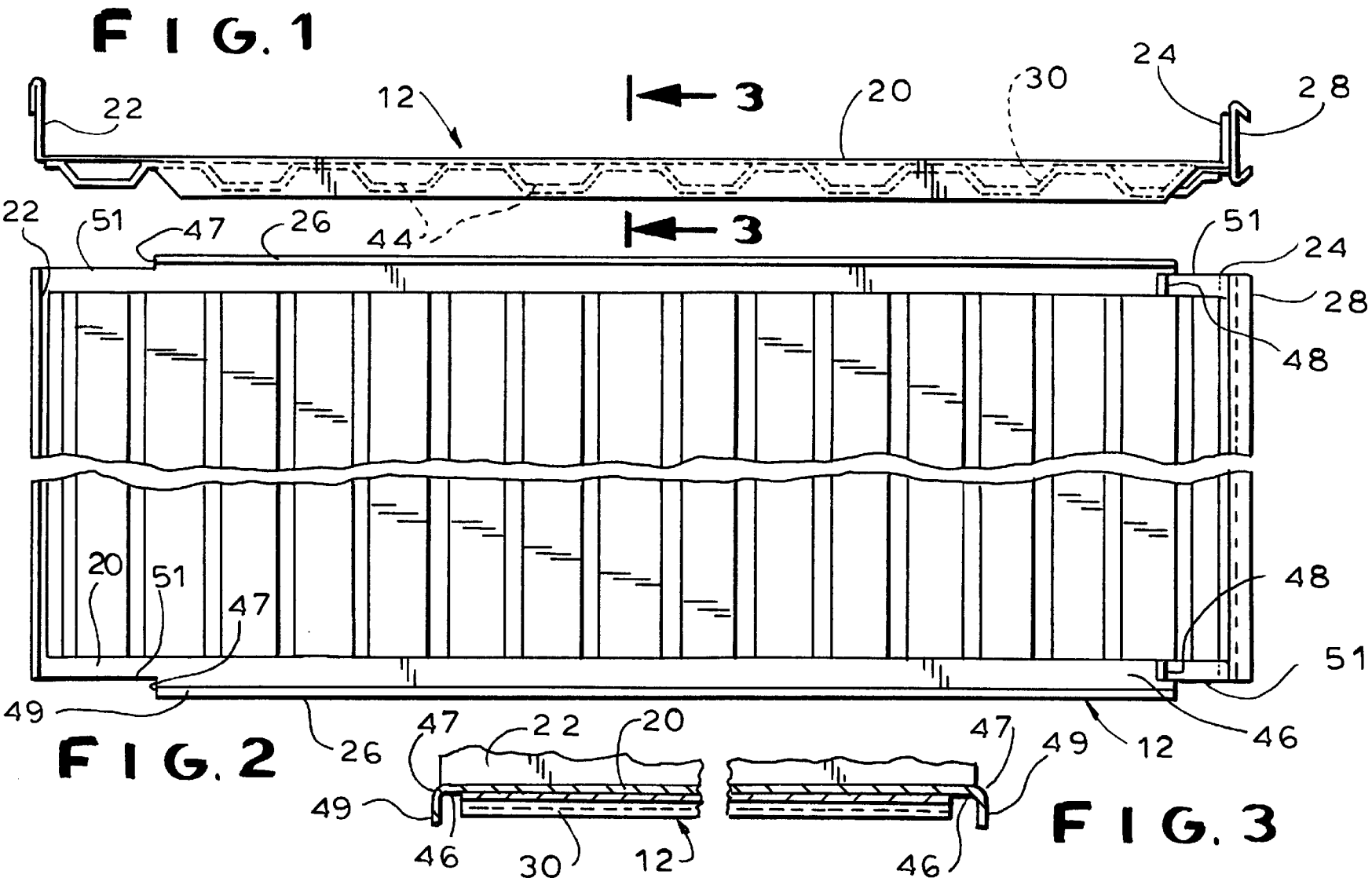
FIG. 1 is a side view of the shelf unit of the present invention.
FIG. 2 is a cut-away bottom plan view of the shelf unit of FIG. 1.
FIG. 3 is a cut-away cross-sectional view taken along line 3—3 of FIG. 1.
Figure 1A:
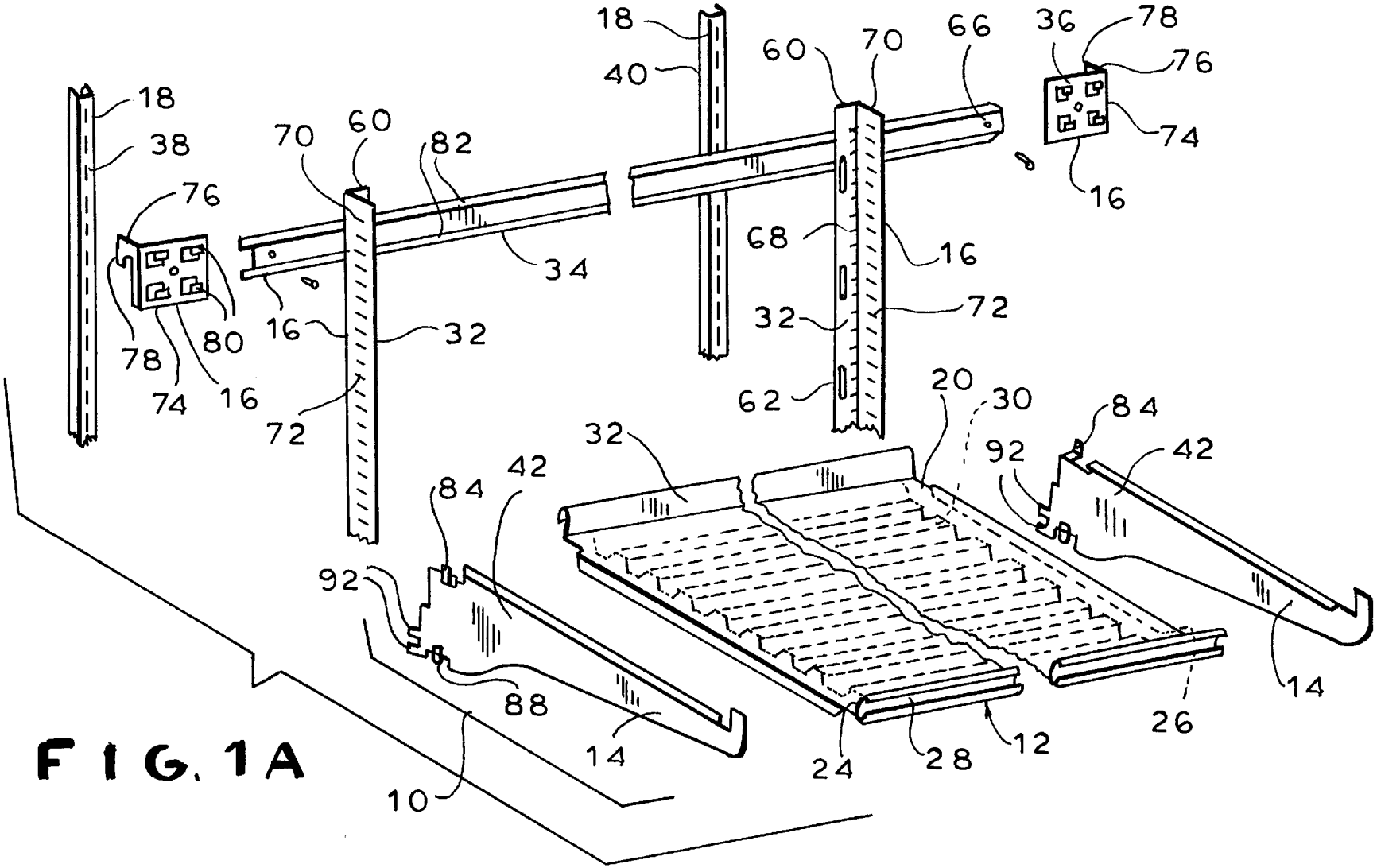
FIG. 1A is an exploded, perspective view of the shelf assembly of the present invention as used in conjunction with a shelving support system.

With reference to the drawings, and initially to FIG. 1A thereof, the shelf assembly 10 of the present invention includes a shelf unit 12 and a pair of shelf brackets 14, which brackets are preferably adapted to cooperate with a shelving support system 16 which, in turn, is designed to mount on a conventional gondola-type system 18.

The shelf unit 12 includes a panel 20, preferably formed of sheet metal, forming a support surface for products. Upwardly-turned rear and front flanges 22, 24, and outwardly-extending and downwardly-turned side flanges 26 extend preferably integrally from the panel 20. The side flanges 26 provide rigidity and, in combination with the shelf brackets 14, provide lateral stability for the shelf unit 12. The rear and front flanges 22, 24 also provide rigidity for the shelf unit 12 as well as providing boundaries for products supported on the panel 20. In addition, a channel member 28 is preferably mounted on the outside surface of the front flange 24 to provide added rigidity to the shelf unit 12 as well as a means to attach a label holder (not shown) such as an extruded plastic label holder for displaying prices, UPC symbols and the like. The shelf unit 12 also includes a corrugated support structure 30 mounted on the underside of the panel 20 to provide strength and rigidity to the shelf unit 12 over substantially the entire product supporting surface.

The shelving support system 16, with which the shelf assembly 10 preferably cooperates, includes auxiliary uprights 32 mounted on a series of crossbars 34. End brackets 36 attach to the crossbars 34 and engage slots 38 in the vertical supports 40 of the known gondola system 18 thereby securing the shelving support system 16 to the gondola 18. The shelf brackets 14 of the shelf assembly 10 of the present invention preferably include end portions 42 adapted to engage the auxiliary uprights 32 of the shelving support system 16.

Referring to FIGS. 1, 2 and 3, the corrugated support structure 30 of the shelf unit 12 includes a plurality of integrally-connected, U-shaped channel members 44 spanning between the side flanges 26. Preferably, the channel members 44 are substantially parallel and are evenly spaced between the front and rear flanges 24, 22 such that the panel 20 is evenly supported over substantially the entire surface thereof. Also, preferably the corrugated support structure 30 does not extend below the side flanges 26 such that the vertical space occupied by the shelf unit 12 is minimized. Preferably, the corrugated support structure 30 is formed of stamped sheet metal and is fixed to the underside of the panel 20 at a plurality of locations by spot welding or other suitable method. Thus, it can be appreciated that the rear, front and side flanges 22, 24, 26, and the corrugated support structure 30, provide substantial rigidity and strength to an otherwise flexible panel 20. In addition, the channel member 28 attached to the front flange 24 provides substantial rigidity and strength along the front edge of the shelf unit 12.

As best seen in FIGS. 2 and 3, preferably the corrugated support structure 30 is spaced from each side flange 26 such that gaps 46 are formed therebetween for accommodating the shelf brackets (not shown). Also preferably the side flanges 26 include outwardly-extending portions 47 and downwardly-turned portions 49 such that the side flanges have a substantially inverted L-shape. Stops 48, preferably located in the gaps 46 adjacent the front flange 24, cooperate with outward ends of the shelf brackets (not shown) to constrain the front-to-back movement of the shelf unit 12 with respect to the shelf brackets.

Figures 4, 5, 6:
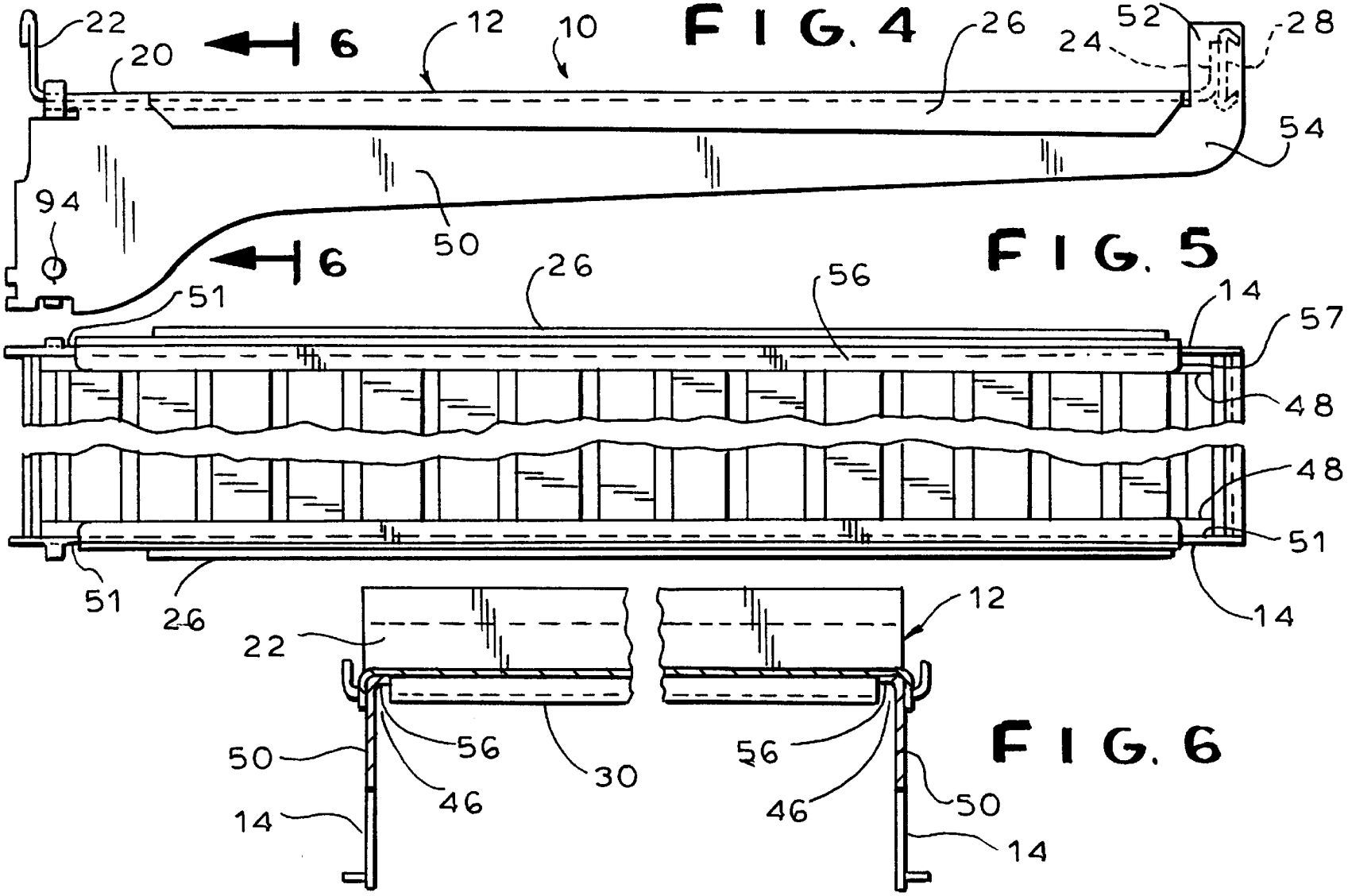
FIG. 4 is a side view of the shelf assembly of the present invention.
FIG. 5 is a cut-away bottom view of the shelf assembly of FIG. 4.
FIG. 6 is a cut-away cross-sectional view of the shelf assembly taken along line 6—6 of FIG. 4.

Referring to FIGS. 4, 5 and 6, the shelf bracket 14 mounts to the underside of the panel 20 in the gap 46 between the corrugated support structure 30 and the side flange 26. The side flanges 26, and specifically the downwardly-turned portions 49 thereof, abut the outside surface 50 of the shelf bracket 14 to provide lateral, side-to-side stability for the shelf unit 12. An arm 52 extends vertically upward from the outward end 54 of the shelf bracket 14 and abuts the front flange 24 and the channel member 28 to provide additional lateral stability. In addition, the arm 52 contacts the outwardly-extending portion 47 of the side flange 26 at the forward end 58 thereof to limit the forward movement of the shelf unit 12. Preferably, the shelf bracket 14 has a thickness that corresponds to the length of the outwardly-extending portion 47 of the side flange 26. That is, the thickness is substantially equal to the distance between the downwardly-turned portion 49 of the side flange 26 and the juncture between the edge 51 of the panel 20 and the outwardly-extending portion 47 of the side flange 26. Thus, when the shelf unit 12 is mounted on the brackets 14, the brackets 14 will contact the downwardly-turned portions 49 of the side flanges 26, on one side, and the edge 51 of the panel 20 and the upwardly-turned front flange 24 (and/or channel member 28) on the other side, providing a secure shelf assembly 10.

As best seen in FIGS. 5 and 6, the shelf bracket 14 can include an inwardly-turned, horizontal upper surface 56 upon which the panel 20 rests. This upper surface 56 also cooperates with the stop 48 to prevent the movement of the shelf unit 12 toward the gondola (not shown). Thus, as can be appreciated, the shelf unit 12 is secured in place by the shelf brackets 14 and is constrained in all directions except upward thereby insuring that the shelf unit 12 is stable and that all similar shelves will remain aligned. Moreover, the configuration of the shelf unit 12 and shelf brackets 14 allow for the shelf unit 12 to be simply lowered or rotated onto the shelf brackets 14 for easy and efficient installation and disassembly.

Referring again to FIG. 1A, the auxiliary uprights 32 are preferably of L-shaped cross-section where a first arm portion 60 of the upright has a series of spaced, elongated vertical slots 62. The slots 62 allow the auxiliary upright 32 to be adjustably mounted to a crossbar 34 by use of a screw (not shown) through one of the slots 62 and into an accepting bore 66 in the end of the crossbar 34. The screw can also affix the crossbar 34 in position to the end bracket 36. The elongated slots 62 allow for vertical adjustment between the uprights 32 and the crossbar 34 to accommodate any minor spacing variations which exist in the arrangement of the slots 38 on the gondola vertical supports 40, and thus the relative vertical positionings of the end brackets 36 supporting the crossbars 34. The first arm portion 60 also includes a series of closely-spaced apertures 68 aligned adjacent the juncture of the first arm portion 60 and a second arm portion 70 of the auxiliary upright 32.

The second arm portion 70 of the auxiliary upright 14, forming a right angle to the first arm portion 60, extends outwardly from the crossbar 34 and is provided with a plurality of closely-spaced, horizontally-extending slots 72. It should be appreciated that while the horizontally-extending slots 72 and the closely-spaced apertures 68 are depicted as discrete features, such slots and apertures can join across the interface between the two arm portions. In any case, the use of such horizontally-oriented slots 72 and apertures 68, which may have a vertical spacing on the order of one-half inch, provide for precise, incremental spacing of the shelves mounted to the auxiliary uprights 32. The vertical slots on the conventional gondola vertical supports 40 do not allow such adjustment to be attained.

The end brackets 36 to which the crossbars 34 are attached are preferably formed in a generally L-shape as seen from above, with a main face portion 74 and a rearwardly-extending, right angle hook arm 76 with a hook portion 78 adapted to be inserted into a slot 38 of a conventional gondola vertical support 40. Preferably, the face portion 74 of the end bracket 36 includes opposed, inwardly-facing clips 80 which cooperate with parallel side rail portions 82 along the edges of the crossbar 34 to secure the crossbar 34 to the end brackets 36. Thus, the shelving support system 16 is adapted to mount to known, conventional gondola systems 18 and specifically to the slots 38 and the vertical supports 40 thereof. Furthermore, the shelving support system 16 provides for precise, incremental spacing of the shelf assembly 10 of the present invention.

Figure 7:
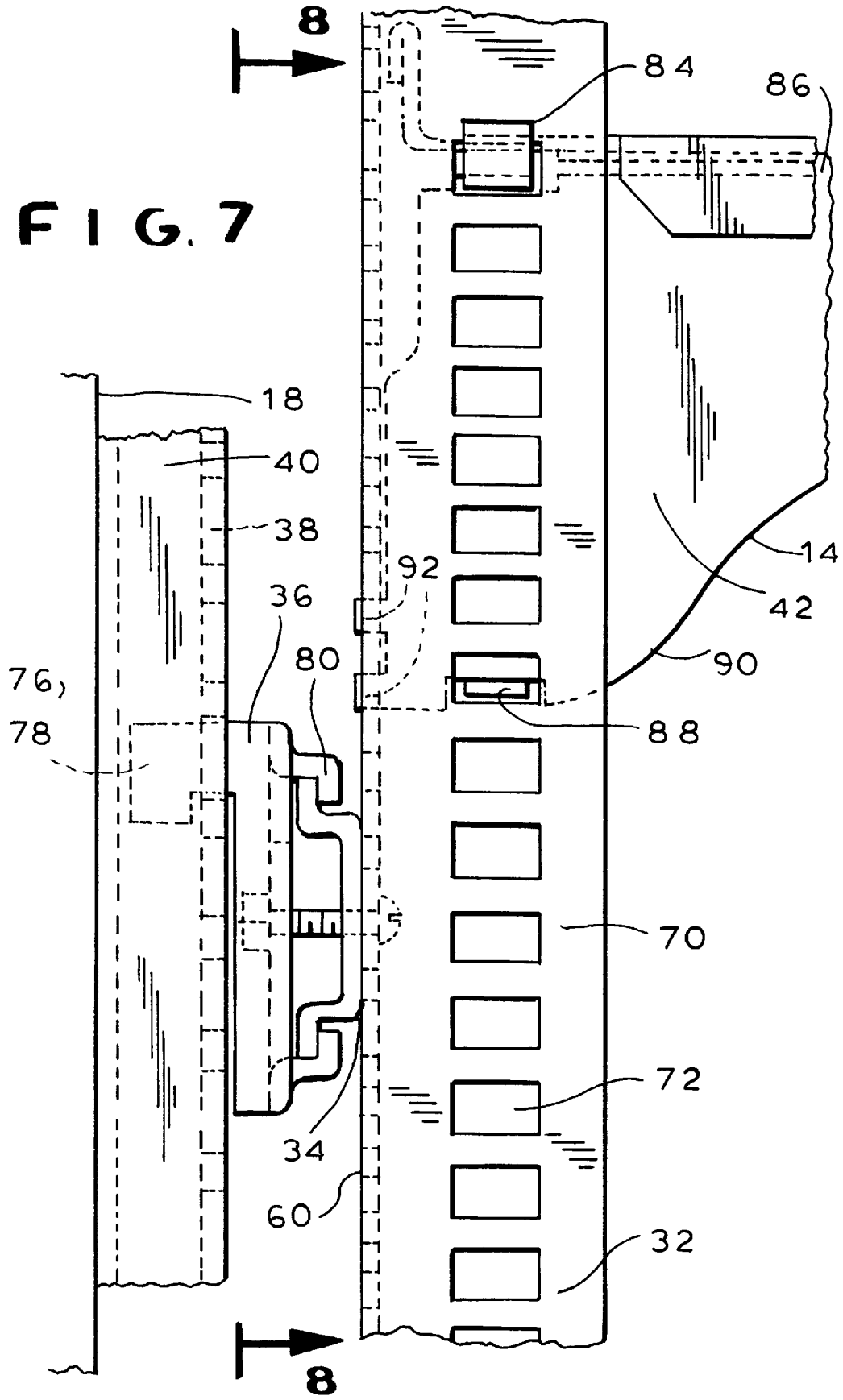
FIG. 7 is a closeup, side elevation view of the shelf assembly of the present invention mounted on the shelving support system of FIG. 1A.
Figure 8:
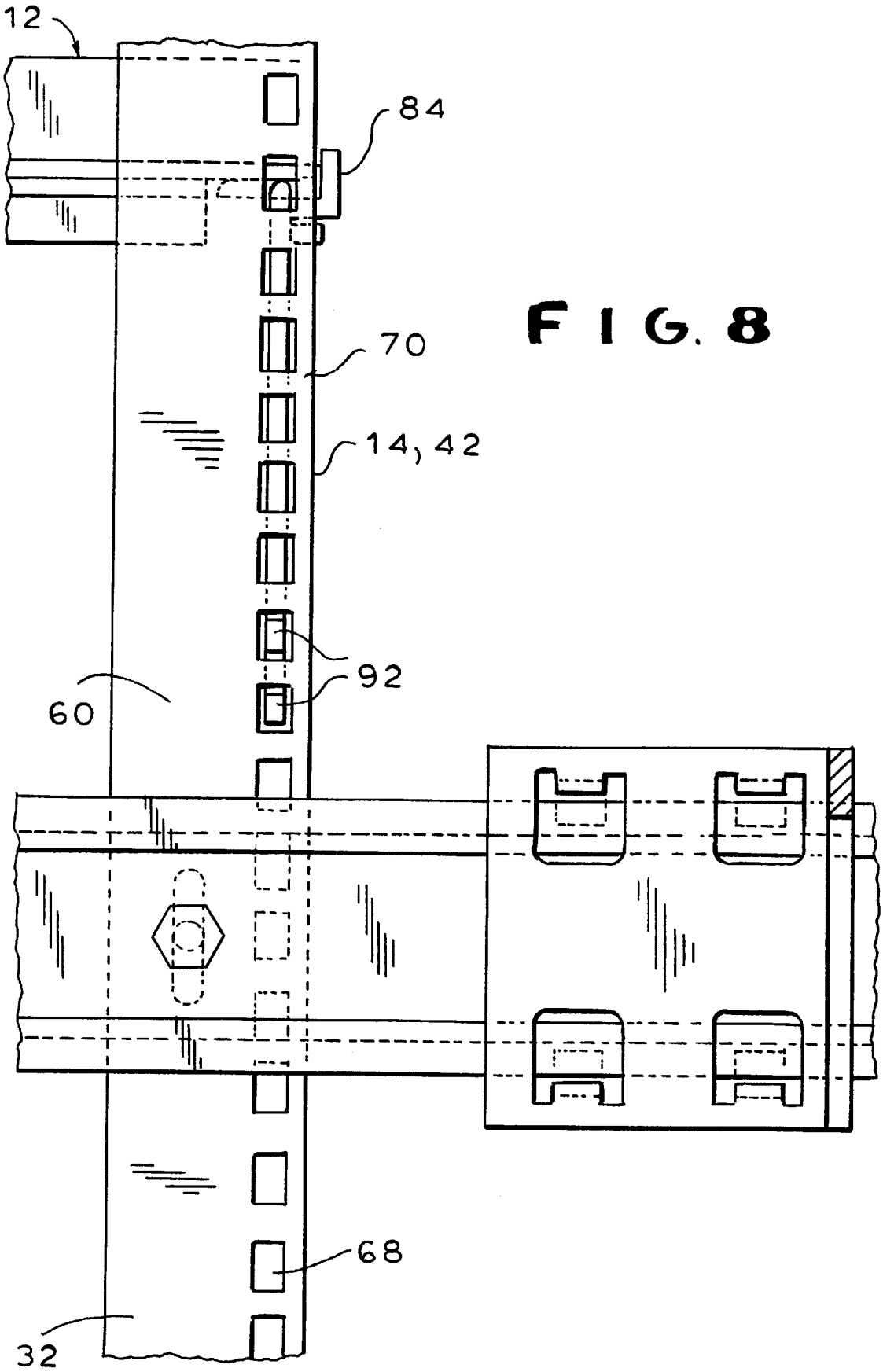
FIG. 8 is a closeup, rear elevation view taken along line 8—8 of FIG. 7.

Referring to FIGS. 7 and 8, preferably the inward ends 42 of the shelf brackets 14 are adapted to mount on the auxiliary uprights 32 such that the shelf assembly 10 of the present invention can be used in conjunction with the above-described shelving support system 16. Specifically, the shelf bracket 14 includes a lug portion 84 on an upper edge 86 thereof, which lug portion 84 is adapted to enter and engage one of the horizontally-extending slots 72 in the second arm portion 70 of the auxiliary upright 32. In addition, there is an outwardly-extending tab 88 located on a lower portion 90 of the shelf bracket 14, which tab 88 is also adapted to engage one of the horizontally-extending slots 72. Further, there are rearwardly-extending tabs 92 which are adapted to engage the closely-spaced apertures 68 of the first arm portion 60 of the auxiliary upright 32. Preferably, the rearwardly-extending tabs 92 have lengths not substantially greater than the thickness of the first arm portion 60 so as to not interfere with the crossbar 34 and end brackets 36. To mount the shelf bracket 14, the bracket is presented at an angle to allow the lug portion 84 to be inserted into one of the horizontally-extending slots 72. Then the shelf bracket 14 is rotated about the lug portion 84 such that the outwardly-extending tab 88 engages another of the horizontally-extending slots 72. Finally, the shelf bracket 14 is rotated downwardly about the lug portion 84 such that the rearwardly-extending tabs 92 enter the closely-spaced apertures 68 in the first arm portion 60 of the auxiliary upright 32. In this position, the shelf bracket 14 is securely mounted on the auxiliary upright 32 and is ready to accept the shelf unit 12. The shelf unit 12, once mounted, prevents the shelf brackets 14 from rotating out of the slots 72 and apertures 68 of the auxiliary uprights 32. For further security, the shelf bracket 14 can include a hole 94 (best seen in FIG. 4) aligned with one of the horizontally-extending slots 72 such that a bolt (not shown) or other fastening means can be used to avoid accidental or unintended disconnection of the shelf brackets 14 from the auxiliary uprights 32.

The present invention therefore provides a novel shelving assembly 10 of a light-weight and economical construction, which is rigid and able to support a significant amount of weight and which cooperates with a shelving support system 16 which is adapted for precise adjustment of shelf height and location. Furthermore, the shelf assembly 10 has a low profile such that it occupies a minimum amount of space in a gondola system. Finally, the shelf assembly 10 is easy to assemble, mount and remove thereby reducing labor costs and time.

It should be understood, of course, that the specific form of the invention herein illustrated and described is intended to be representative only, as certain changes may be made therein without departing from the clear teachings of the disclosure. Specifically, and by way of example only, the shelf brackets 14 can be adapted to mount directly to the vertical supports 40 of a conventional gondola system 18 without departing from the spirit and scope of the invention. Accordingly, reference should be made to the following appended claims in determining the full scope of the invention.

I claim:

1. A shelf assembly for use with a shelving support system having a pair of spaced, aperture-bearing uprights, said shelf assembly comprising:

(a) a pair of shelf brackets adapted to be mounted on said uprights;

(b) a shelf unit adapted to be mounted on said shelf brackets, said shelf unit having a panel adapted to support products thereon;

(c) said panel having side flanges extending outwardly and downwardly therefrom, downwardly extending portions of said side flanges engaging outside surfaces of said shelf brackets to limit the lateral movement of said shelf unit with respect thereto;

(d) a support structure connected to an underside of said panel, said support structure extending from adjacent each of said side flanges and providing support substantially evenly between front and back edges of said panel;

(e) said support structure being spaced from said downwardly extending portions of said side flanges forming gaps therebetween to accommodate said shelf brackets such that, when said shelf unit is mounted on said shelf brackets, an underside of said panel contacts said shelf brackets thereby reducing the vertical space occupied by said shelf assembly;

(f) said shelf brackets having first stops engaging said side flanges to limit the forward movement of said shelf unit with respect to said shelf brackets;

(g) said shelf unit having second stops engaging said shelf brackets to limit the rearward movement of said shelf unit with respect thereto;

(h) said support structure further comprising a corrugated member having a plurality of integrally-connected channels extending laterally from adjacent each of said side flanges, said channels being substantially evenly spaced between said front and rear edges of said panel to provide even support for substantially the entire surface of said panel;

(i) said corrugated member having a height not greater than a vertical distance between said underside of said panel and bottoms of said downwardly-extending portions of side flanges such that said corrugated member does not extend below said side flanges;

(j) said shelf unit further comprising an upwardly-turned front flange means;

(k) said first stops further comprise upwardly-turned arm portions on ends of said shelf brackets, said arm portions being adapted to engage forwardly-facing surfaces of said outwardly-extending portions of said side flanges, and being adapted to engage a side edge of said panel and said front flange means;

(l) said shelf brackets further comprise inwardly-extending, horizontal support flanges adapted to engage said underside of said panel;

(m) said second stops engage said inwardly-extending horizontal support flanges; and (n) said outwardly-extending portions of said side flanges extend outward from said panel a distance substantially equal to a thickness of said shelf brackets.

2. The shelf assembly of claim 1, wherein said shelf unit further comprises an upwardly-turned rear flange, and a forwardly-facing channel member connected to said front flange means, said forwardly-facing channel member being rigid to provide support for said panel and being adapted to support label holding structure.

3. The shelf assembly of claim 2, wherein said front, rear and side flanges are integral and in one piece with said panel.

4. The shelf assembly of claim 3, wherein:

(a) said aperture-bearing uprights further comprise:

(i) first and second arm portions aligned at substantially 90 degrees and defining an L-shaped cross section;

(ii) a column of closely-spaced apertures in said first arm portion, said closely-spaced apertures being disposed adjacent the junction of said first and second arm portions; and (iii) a column of closely-spaced, horizontally-extending slots in said second arm portion; and (b) said shelf brackets further comprise rearward end portions adapted to engage said slots and apertures of said first and second arm portions of said uprights.

5. The shelf assembly of claim 4, wherein each shelf bracket further comprises:

(a) a lug portion extending outwardly and upwardly from an upper edge of said rearward end, said lug portion being adapted to be inserted through and to engage one of said horizontally-extending slots in said second arm portion;

(b) a first tab extending outwardly from said rearward end, said tab being adapted to engage another of said horizontally-extending slots below said lug portion; and (c) at least one second tab extending rearwardly from said rear portion, said second tab being adapted to engage one of said apertures in said first arm portion.

6. The shelf assembly of claim 5, wherein said second tab of said shelf bracket has a length not substantially greater than a thickness of said first arm portion.

7. The shelf assembly of claim 6, wherein said shelf brackets further comprises a hole through said rear portions thereof, said hole being aligned with one of said horizontally-extending slots when said shelf brackets are mounted to one of said uprights, said hole being adapted to accept a fastening means therethrough for securing said shelf brackets to said uprights.

8. The shelf assembly of claim 4, wherein said aperture-bearing uprights are adapted to be supported by vertical supports of a gondola display.

9. The shelf assembly of claim 8, further comprising:

(a) end bracket means adapted to engage slots in said vertical supports of the gondola display;

(b) cross bar means adapted to be mounted on said end bracket means; and (c) said aperture-bearing uprights being mountable on said cross bar means.

10. A shelf assembly for use with a shelving support system having a pair of spaced, aperture-bearing uprights, said shelf assembly comprising:

(a) a shelf unit having a panel to support products, having two side edges and having two side flanges, one side flange depending from each of said two side edges, (b) each said side flange having a portion extending outwardly from an associated side edge and having a portion extending downwardly from said outwardly extending portion, (c) a corrugated support structure connected to an underside of said panel, said support structure substantially spanning a distance between said side flanges to provide support substantially evenly between front and back edges of said panel, (d) said support structure being spaced a distance from said downwardly-extending portions of said side flanges forming gaps therebetween, and extending downwardly from said panel a distance not greater than a length of said downwardly extending portion of said side flanges, (e) a pair of shelf brackets, each bracket having an upwardly-extending arm extending above said panel and each bracket having a width substantially equal to a length of said outwardly-extending portion of said side flanges, said upwardly-extending arm being in contact with one of said side edges of said panel, and an outside surface of said bracket being in contact with an downwardly-extending portion of an associated side flange, (f) said upwardly-extending arm of each bracket also contacting said outwardly-extending portion of an associated side flange to limit the forward movement of said shelf unit, (g) each bracket including an inwardly-turned portion forming a horizontal upper surface in contact with an underside of said panel, and (h) stops located in said gaps between said side flanges and said support structure, said stops being in contact with said inwardly-turned portions of said brackets to limit the rearward movement of said shelf unit.

11. The shelf assembly of claim 10, wherein said shelf unit further comprises an upwardly-turned rear flange, and a forwardly-facing channel member connected to a front flange means, extending upwardly from a front edge of said panel, said forwardly-facing channel member being rigid to provide support for said panel and being adapted to support label holding structure.

12. The shelf assembly of claim 11, wherein said front, rear and side flanges are integral and in one piece with said panel.

13. The shelf assembly of claim 12, wherein:

(a) said aperture-bearing uprights further comprise:

(i) first and second arm portions aligned at substantially 90 degrees and defining an L-shaped cross section;

(ii) a column of closely-spaced apertures in said first arm portion, said closely-spaced apertures being disposed adjacent the junction of said first and second arm portions; and (iii) a column of closely-spaced, horizontally-extending slots in said second arm portion; and (b) said shelf brackets further comprise rearward end portions adapted to engage said slots and apertures of said first and second arm portions of said uprights.

14. The shelf assembly of claim 13, wherein each shelf bracket further comprises:

(a) a lug portion extending outwardly and upwardly from an upper edge of said rearward end, said lug portion being adapted to be inserted through and to engage one of said horizontally-extending slots in said second arm portion;

(b) a first tab extending outwardly from said rearward end, said tab being adapted to engage another of said horizontally-extending slots below said lug portion; and (c) at least one second tab extending rearwardly from said rear portion, said second tab being adapted to engage one of said apertures in said first arm portion.

15. The shelf assembly of claim 14, wherein said second tab of said shelf bracket has a length not substantially greater than a thickness of said first arm portion.

16. The shelf assembly of claim 15, wherein said shelf brackets further comprise a hole through said rear portions thereof, said hole being aligned with one of said horizontally-extending slots when said shelf brackets are mounted to one of said uprights, said hole being adapted to accept a fastening means therethrough for securing said shelf brackets to said uprights.

17. The shelf assembly of claim 13, wherein said aperture-bearing uprights are adapted to be supported by vertical supports of a gondola display.

18. The shelf assembly of claim 17, further comprising:

(a) end bracket means adapted to engage slots in said vertical supports of the gondola display;

(b) cross bar means adapted to be mounted on said end bracket means; and (c) said aperture-bearing uprights being mountable on said cross bar means.

* * * * *